US005090633A

United States Patent [19]

Ohashi

[11] Patent Number: 5,090,633

[45] Date of Patent: Feb. 25, 1992

[54] PACKAGE WINDING METHOD

[75] Inventor: Kenji Ohashi, Uji, Japan

[73] Assignee: Murata Kikai Kabushiki Kaisha, Kyoto, Japan

[21] Appl. No.: 550,159

[22] Filed: Jul. 9, 1990

[30] Foreign Application Priority Data

Jul. 14, 1989 [JP] Japan ..... 1-182120

[51] Int. Cl.[5] ..... B65H 54/38; B65H 54/48

[52] U.S. Cl. ..... 242/18.1; 242/43.2

[58] Field of Search ..... 242/18.1, 43.2

[56] References Cited

U.S. PATENT DOCUMENTS 3,690,579 9/1972 Porter et al. ..... 242/18.1 X
4,504,021 3/1985 Schippers et al. ..... 242/18.1
4,504,024 3/1985 Gerhartz ..... 242/18.1

FOREIGN PATENT DOCUMENTS 79536 2/1950 Czechoslovakia ..... 242/43.2
402849 3/1943 Italy ..... 242/43.2

*Primary Examiner*—Stanley N. Gilreath
*Attorney, Agent, or Firm*—Spensley Horn Jubas & Lubitz

[57] ABSTRACT

A package is wound using a drum having traverse grooves with different wind numbers. During the winding of the package, the drum wind number by which a supplied yarn is wound onto a package is changed to another drum wind number when the diameter of the package approaches a value at which ribbon winding occurs so that ribbon winding is prevented.

12 Claims, 4 Drawing Sheets

PACKAGE WINDING METHOD

FIELD OF THE INVENTION

The present invention relates to a method of winding a yarn package while rotating the package on a drum, and particularly relates to a method of winding a yarn package by a winder to enable the prevention of ribbon winding.

RELATED ART STATEMENT

An automatic winder, which makes a cone package by rewinding from a spinning bobbin subjected to spinning, winds a supplied yarn while the package is rotated on a drum having a traversing groove. The yarn is guided by the groove so as to be traversed back and forth. When the diameters of the drum and the package have a prescribed relationship to each other such that the rotational frequency of the drum is equal to an integer multiple of the package or to the reciprocal of the latter, the period of the traversing of the yarn by the traversing groove and the period of the winding of the yarn correspond to each other so that what is called "ribbon winding", in which yarn to be wound is moved through the same passage and overlaid at the same place on the peripheral surface of the package, occurs. Ribbon winding results in yarn breakage due to sloughing, latching or the like during unwinding of the yarn from the package.

Conventional methods of preventing ribbon winding were proposed. In one of the methods, a package is separated from a drum at the time of the approach to a ribbon winding diameter so as to cause a slip between the package and the drum. In another of the methods, a drum is braked at the time of the approach to a ribbon winding diameter so as to change the rotational frequency of the drum.

Although a package has been recently required to be good enough to enable rapid unwinding, the abovementioned ribbon winding prevention methods are not good enough to enable the rapid unwinding. This is a problem.

OBJECT AND SUMMARY OF THE INVENTION

The present invention was made in consideration of the above-mentioned circumstances. Accordingly, it is an object of the present invention to provide a package winding method good enough to enable rapid unwinding.

In the package winding method provided in accordance with the present invention, a package is wound using a drum having traversing grooves different from each other in wind number. At the start of the winding of the package, the package is wound at a wind number and the diameter of the package is detected, the wind number is changed for another wind number at the time when the diameter of the package approaches the value of the ribbon occurrence diameter to wind the package further, and then the latter wind number is changed for the former after the diameter of the package passes over the value of the ribbon winding occurrence diameter to wind the package still further.

According to the present invention, during the winding of the package the wind number is changed to the another wind number when the diameter of the package approaches the value of the ribbon occurrence diameter so that ribbon winding is prevented. The wound package is thus made good enough to enable rapid unwinding.

DETAILED DESCRIPTION OF PREFERRED EMBODIMENT

A preferred embodiment of the present invention is hereafter described with reference to the drawings.

Figure 1:
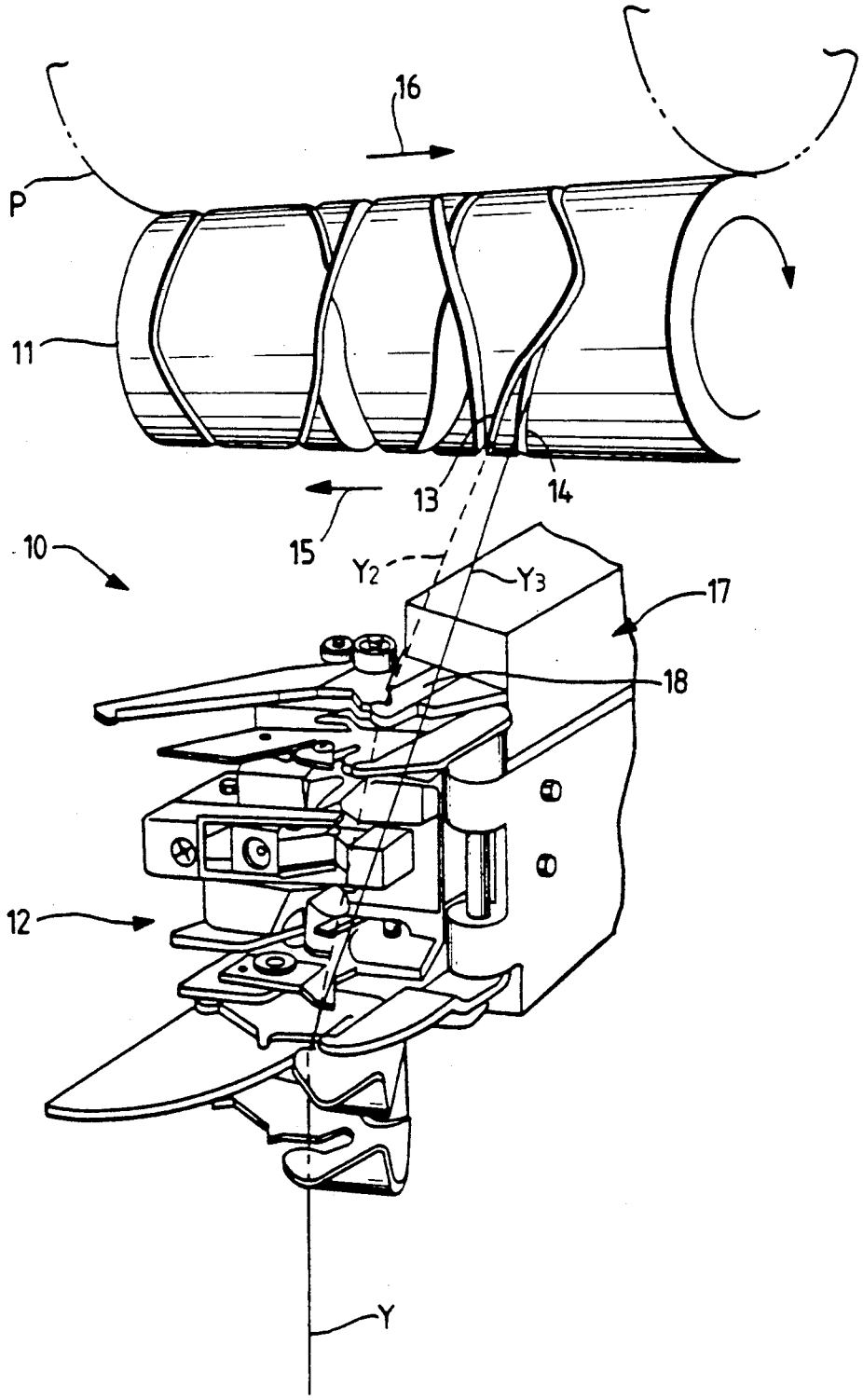
FIG. 1 is a perspective view of a winding unit for an embodiment of the present invention.

FIG. 1 shows the winding unit 10 of an automatic winder, which has a drum 11 and a yarn splicing device 12 provided under the drum 11. The drum 11 acts to rotate a package P to wind a supplied yarn Y thereon. The drum 11 is rotated in a direction shown by an arrow in FIG. 1. The peripheral surface of the drum 11 has traversing grooves 13 and 14 for traversing the supplied yarn Y to go and to return. The grooves 13 and 14 are provided so that the yarn Y can be selectively wound either by the two winds of the drum 11 or by the three winds thereof when the yarn is traversed in a forward direction 15 shown by an arrow in FIG. 1, and that the yarn can be wound only by the two winds of the drum when the yarn is traversed in a backward (or return) direction 16 shown by another arrow in FIG. 1. Winding the yarn Y by the two winds of the drum 11 at the time of the traversing of the yarn in the forward direction 15 or winding the yarn by the three winds of the drum at the time of the traversing of the yarn in the forward direction can be selected by moving the changing rod 18 of a changer 17 provided at the upper portion of the yarn splicing device 12. If the changing rod 18 is moved out as shown in FIG. 1, the supplied yarn Y is hindered by the rod at the time of the shift of the yarn from the backward direction 16 to the forward direction 15 so that the yarn is put into the forward direction through a yarn passage Y2 shown by a dotted line in FIG. 1 and then enters into the traversing groove 13 for winding the yarn by the two winds of the drum 11. If the changing rod 18 is moved in, the supplied yarn Y is moved through a yarn passage Y3 shown by a full line in FIG. 1, at the time of the shift of the yarn from the backward direction 16 to the forward direction 15, and then enters into the traversing groove 14 for winding the yarn by the three winds of the drum 11.

Figure 2:
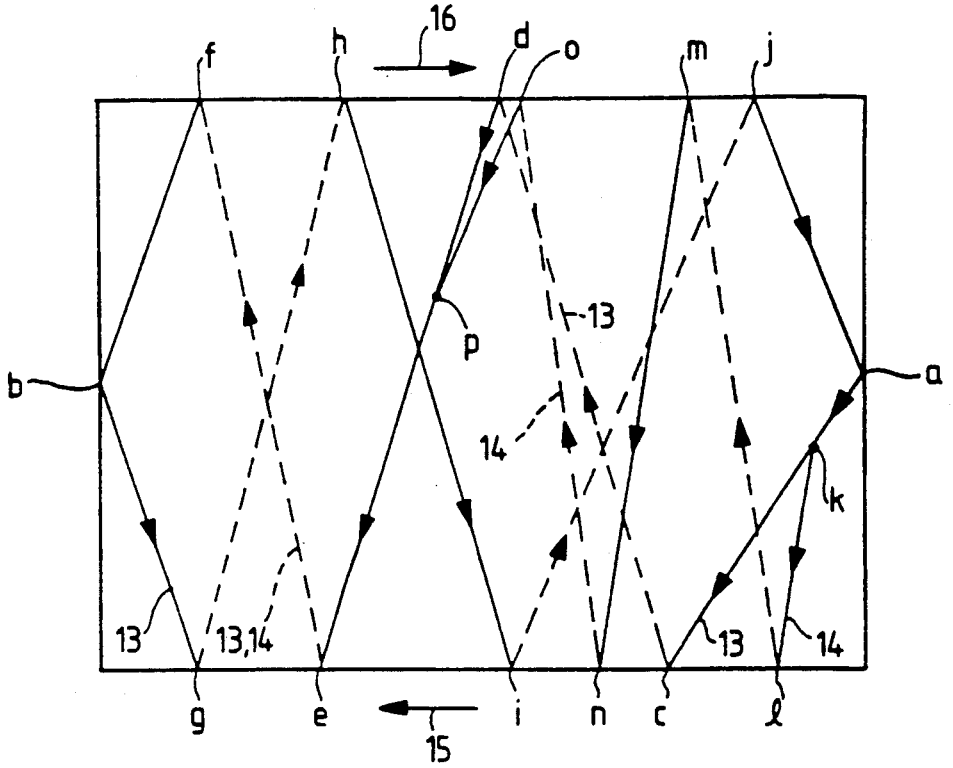
FIG. 2 is a front view of a grooved yarn traversing drum for describing the traversing grooves of a drum.

The traversing grooves 13 and 14 of the drum 11 are described in detail with reference to FIG. 2 from now on. FIG. 2 is a front view of the drum 11. Shown in FIG. 2 are a shift point a at which the yarn is shifted from the backward direction 16 to the forward direction 15, and another shift point b at which the yarn is shifted from the forward direction to the backward direction. It is herein supposed that the shift points a and b corresponds to the angle of 0 degrees, a lower horizontal line shown in FIG. 2 corresponds to the angle of 90 degrees, and an upper horizontal line shown in FIG. 2 corresponds to the angle of 270 degrees, with regard to the circumference of the drum 11. When the yarn Y is traversed in the forward direction 15 through the traversing groove 13 for the two winds, the yarn is moved from the shift point a to the other shift point b through a point c, a portion of the groove, which is shown by a dotted line in FIG. 2 because the portion is located on the back of the drum with regard to FIG. 2, and other points e and f, so that the yarn is wound by the two winds of the drum 11. When the yarn Y is then traversed in the backward direction 16 through the groove 13 from the shift point b, the yarn is moved to the other shift point a through points g, h, i and so that the yarn is wound by the two winds of the drum 11 before the yarn is traversed again in the forward direction 15. When the yarn Y is traversed in the forward direction 15 through the other traversing groove 14 for the three winds, the yarn is first moved in the groove 13 from the shift point a, then put into the groove 14 at a branching point k, and, moved in the groove 14 through points l, m, n and o and a joining point p so as to be wound nearly two winds of the drum 11, and is then put into the other groove 13 at the joining point and moved therein to the shift point b through the points e and f so as to be wound by nearly one wind of the drum, thus being wound by the three winds in all thereon. When the yarn Y is then traversed in the backward direction 16 from the shift point b, the yarn is moved to the other shift point a through the groove 13 for the two winds so that the yarn is wound by the two winds of the drum 11.

Figure 3:
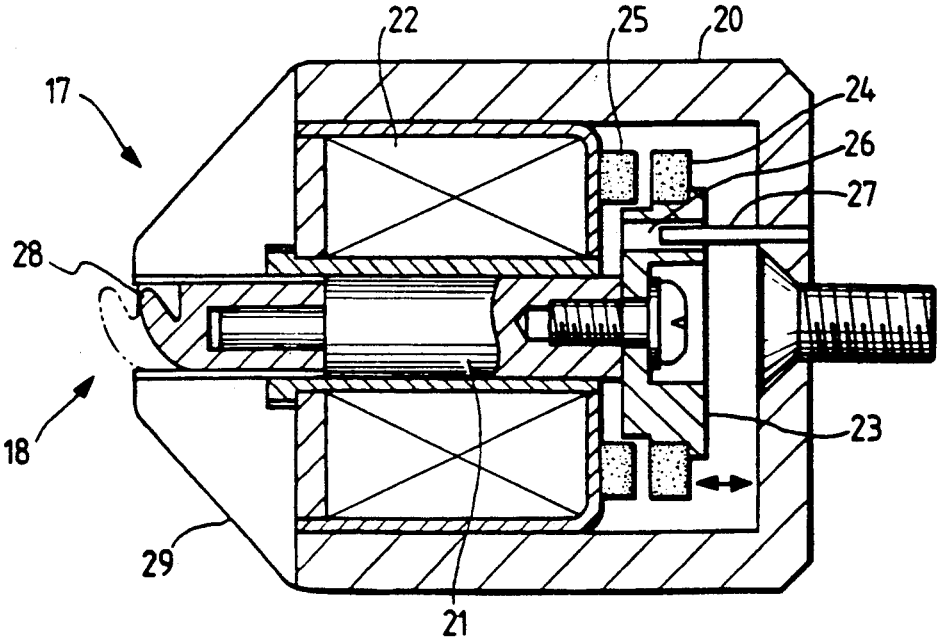
FIG. 3 is a detailed sectional view of a changer shown in FIG. 1.

The changer 17 for changing the movement of the yarn Y to the traversing groove 13 for the two winds or the traverse groove 14 for the three winds is described in detail with reference to FIG. 3. The changing rod 18 is movably supported in the body 20 of the changer 17. An electromagnetic coil 22 is provided in the body 20 and surrounds the movable iron core 21 of the changing rod 18. A disk 23 is provided at the rear end of the movable core 21. A movable magnet 24 is provided on the disk 23. A fixed magnet 25 is provided behind the electromagnetic coil 22 and faces the movable magnet 24. The disk 23 has a rotation restricting hole 26 in which a restricting bar 27 secured in the body 20 is inserted. The changing rod 18 is formed with a hook 28 at the front end of the rod so that the hook can be moved into and out of a guide plate 29 provided on the front of the body 20. The same poles of the movable and the fixed magnets 24 and 25 are opposed to each other so that the magnets repulse each other. When electricity is not applied to the electromagnetic coil 22, the changing rod 18 is moved so that the hook 28 is moved into the guide plate 29. When electricity is applied to the coil 22, the changing rod 18 is moved against the magnetic forces of the magnets 24 and 25 so that the hook 28 is moved out of the guide plate 29.

When the changer 17 is put in action, the yarn is wound by the two winds of the drum 11 in each of the forward and the backward directions 15 and 16. When the changer 17 is out of action, the yarn Y is wound by the three winds of the drum 11 in the forward direction 15 and by the two winds thereof in the backward direction 16. For that reason, there are wind number (wind number) combinations A, B and C for two traversing reciprocations of the supplied yarn Y as follows:

(A) 3 winds, 2 winds, 3 winds and 2 winds:
2.5 winds in average
(B) 3 winds, 2 winds, 2 winds and 2 winds:
2.25 winds in average
(C) 2 winds, 2 winds, 2 winds and 2 winds:
2 winds in average The combination A is made when the changer 17 is always out of action. The combination B is made when the changer 17 is out of action throughout the first reciprocation of the yarn Y and in action throughout the second reciprocation thereof. The combination C is made when the changer 17 is always in action.

The diameter R mm of the package at which ribbon winding on the package P occurs is generally expressed by a formula as follows:

$$R = D \times \frac{DW}{PW}$$

Figure 4:
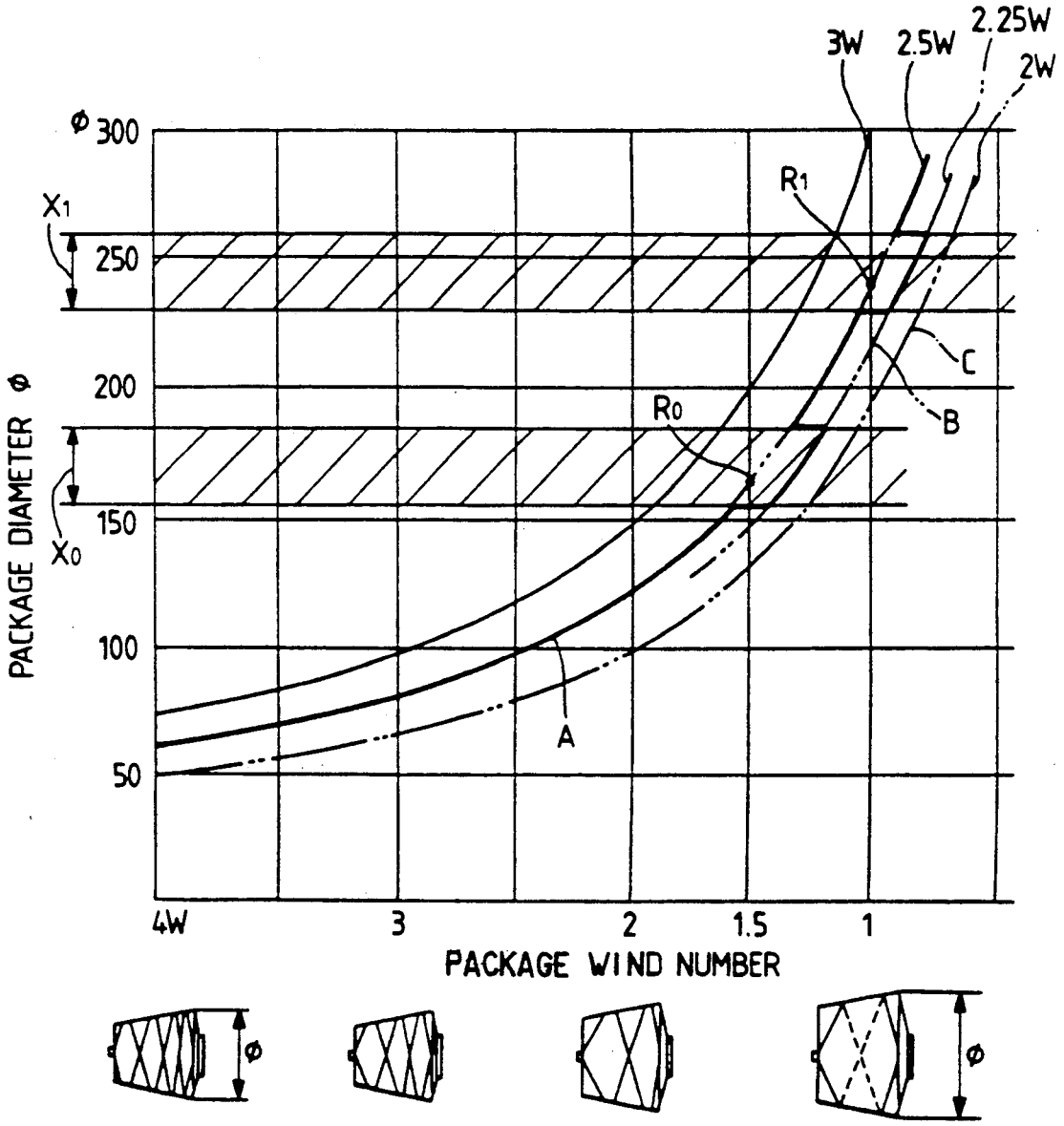
FIG. 4 is a drawing showing the relationship between the wind number of a package and the diameter thereof at the wind number of the drum.

In the formula, D, DW and PW denote the diameter (mm) of the drum 11, the wind numbers of the drum, and the wind numbers of the package respectively. If the diameter of the drum 11 is 100 mm and the yarn Y is wound on the package P by the 2.5 winds, 2.25 winds or 2 winds of the drum during every traverse of the yarn, the relation between the diameter of the package P and the wind numbers of the package changes as shown by a curve A, B or C in FIG. 4. The yarn Y undergoes ribbon winding, theoretically with the diameters $\phi$ of the package P at the points of the crossing of the curves A, B and C with lines indicative of package wind numbers of 4, 3.5, 1.5 and 1 in FIG. 4. Since the diameter of the package P is small and the angle of crossing of the yarn Y thereon is large as to the region in which the package wind number is large, there is no problem in unwinding the yarn from the package. However, as for the small package wind numbers of 1.5 winds and 1 wind in the main, there is a problem in unwinding the yarn Y from the package P. FIG. 4 also shows a curve for a drum wind number of 3.

If the yarn Y is wound on the package P at the drum wind number combination A for 2.5 winds on average, the yarn undergoes such ribbon winding at the package wind numbers of 1.5 and 1.0 that there is a problem in rapidly unwinding the yarn from the package. In that case, the diameter of the package P is $R_0 = 165$ mm at the package wind number of 1.5, and $R_1 = 247.5$ mm at the package wind number of 1. The winding unit is shifted from the drum wind number combination A to the other drum wind number combination B in a ribbon winding prevention area $X_0$ from 155 mm to 180 mm in the diameter of the package P around the ribbon winding package diameter $R_0$ and in another ribbon winding prevention area $X_1$ from 230 mm to 260 mm in the diameter of the package P around the other ribbon winding package diameter $R_1$ so that the ribbon winding is prevented at the package diameters $R_0$ and $R_1$. Since the drum wind number is changed only by 0.25 in that case, the change is not sharp and is smooth.

Figure 5:
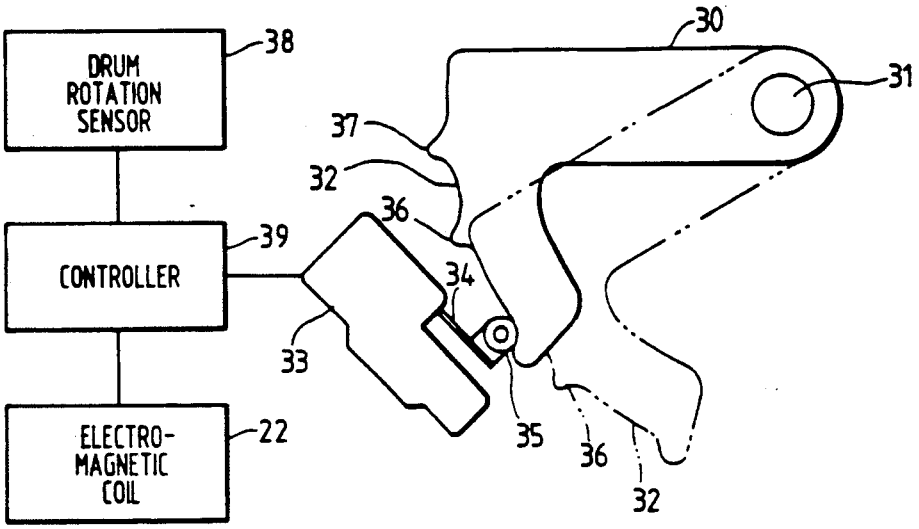
FIG. 5 is a detailed view of a package diameter detection lever for ribbon winding prevention control.
Figure 6:
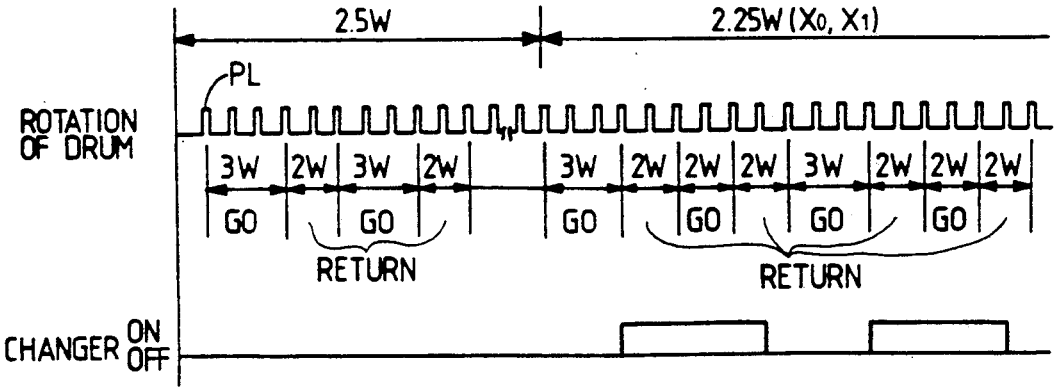
FIG. 6 is a diagram for describing the operation of the changer in connection with the rotation of the drum.

A concrete procedure of changing the combination A for 2.5 winds in average to the other combination B for 2.25 winds in average is described with reference to FIGS. 5 and 6. FIG. 5 shows a package diameter detection lever 30, which is swung according as the diameter of the package P increases. The lever 30 is swung about a shaft 31 from a winding start position shown by a full line FIG. 5 to a full winding position shown by a two-dot chain line therein. For example, the swing is caused in conjunction with a cradle arm which supports the package P but is not shown in the drawings. The arc-shaped portion 32 of the lever 30 is located in contact with a roller 35 on a lever 34 included in a limit switch 33 attached to a fixed part. The position of the roller 35, which is shown in FIG. 5, corresponds to the winding start position of the lever 30. The arc-shaped portion 32 of the lever 30 has projections 36 and 37 for pushing the roller 35 to put the limit switch 33 into action in the ribbon winding prevention areas $X_0$ and $X_1$ shown in FIG. 4. At the time of the increase in the diameter of the package P, the package diameter detection lever 30 is swung to the full winding position shown by the two-dot chain line in FIG. 5. The projections 36 and 37 put the limit switch 33 into action to perform ribbon winding prevention control in which the drum wind number is shifted from 2.5 winds to 2.25 winds, namely, the combination A is changed for the other combination B. At the drum wind number of 2.5, the changer 17 is out of action. At the drum wind number of 2.25, the changer 17 is put into and out of action once for two reciprocations of the yarn in the forward and the backward directions 15 and 16.

Control for putting the changer 17 into and out of action is described with reference to FIG. 6 from now on. A drum rotation sensor 38 (shown in FIG. 5) is provided on the drum 11, which sends out a single pulse PL per rotation of the drum. At the drum wind number of 2.5 in average, the changer 17 is out of action so that the yarn Y is wound on the package P at the combination A of 3 winds, two winds, 3 winds and 2 winds for every two reciprocations in going and returning directions of traversing. When the drum wind number of 2.5 in average is changed for the other drum wind number of 2.25 in average, the winding unit is shifted to the combination B of 3 winds, 2 winds, 2 winds and 2 winds for every two reciprocations in the directions of traversing. In that case, a controller 39 (shown in FIG. 5) reads the number of the pulses from the drum rotation sensor 38 and puts the changer 17 into action during the traversing of the yarn in the returning direction in the first reciprocation for three winds and then two winds. As a result, the yarn is wound by two winds of the drum 11 in each of the going and the returning directions of traversing of the yarn in the second reciprocation. The changer 17 is put out of action during the traversing of the yarn in the returning direction in the second reciprocation. Since the number of the rotations of the drum 11 for two reciprocations of the yarn at the drum wind number of 2.25 in average is nine, the controller 39 puts the changer 17 into and out of action at every nine pulses from the drum rotation sensor. When pushing the roller 35 of the limit switch 33 by the projections 36 and 37 as described above with reference with FIG. 5 is terminated, the changer 17 is put out of action so that the yarn is wound on the package P at the drum wind number combination A.

As described above, the diameter of the package is detected by the lever 30 so that when the diameter is near the ribbon winding occurrence value, the supplied yarn Y is shifted from a drum wind number to another one to prevent the yarn from undergoing ribbon winding.

Although the embodiment is described above as to the example that the yarn is wound at the drum wind number combination A and thereafter shifted therefrom to the other combination B near the ribbon winding occurrence diameter of the package, the yarn may be shifted from the combination A to the other combination C near the diameter. For the latter shifting, the changer 17 is only kept in action in the ribbon winding prevention areas $X_0$ and $X_1$. In that case, the ribbon winding is prevented without detecting the rotation of the drum. Although the yarn is first wound at the combination A in the example, the yarn may be first wound at any of the combinations A, B and C. Although two winds and three winds are combined together in every two reciprocations so as to set the average drum wind numbers in the example, two winds and one wind may be combined together in every two reciprocations so as to set other average drum wind numbers or a different average drum wind number may be set in every single reciprocation.

As understood from the above description, a good effect mentioned hereinafter is produced by the present invention.

During the winding of a yarn as a package, the diameter of the package is detected so that the number of the winds of a drum by which the yarn is wound is changed near the ribbon winding occurrence diameter of the package to prevent ribbon winding, to make possible to rapidly unwind the yarn.

What is claimed is:

1. A method for winding a package using a traverse drum having a plurality of traverse grooves, the method comprising the steps of:

detecting a diameter of the package, winding the package using a first predetermined combination of traverse grooves when the detected diameter of the package is within a first predetermined range of values, and winding the package using a second predetermined combination of traverse grooves when the detected diameter of the package is within a second predetermined range of values.

2. A method according to claim 1, wherein the diameter of the package is continuously detected, and wherein the package is wound using the first predetermined combination of traverse grooves when the detected diameter is within a third predetermined range of values.

3. A method according to claim 2, wherein the package is wound using the second predetermined combination of traverse grooves when the detected diameter is within a fourth predetermined range of values.

4. A method according to claim 3, wherein the package is wound using the first predetermined combination of traverse grooves when the detected diameter is within a fifth predetermined range of values.

5. A method according to claim 3, wherein the fourth predetermined range of values correspond to values at which ribbon winding occurs.

6. A method according to claim 1, wherein the second predetermined range of values correspond to values at which ribbon winding occurs.

7. An apparatus for winding a package using a traverse drum having a plurality of traverse grooves, comprising:

diameter detecting means for detecting a diameter of the package, winding control means, responsive to the detected diameter of the package, for winding the package using a first predetermined combination of traverse grooves when the detected diameter of the package is one of a first predetermined set of values, and winding the package using a second predetermined combination of traverse grooves when the detected diameter of the package is one of a second predetermined set of values.

8. An apparatus for winding a package according to claim 7, wherein the winding control means includes a changing means for changing the yarn from at least one of the plurality of traverse grooves to another of the plurality of traverse grooves.

9. An apparatus for winding a package according to claim 8, wherein the changing means includes:

a changing rod having a hook at one end, a movable iron core and a disk, the disk being secured at the other end of the changing rod and provided with a first magnet, support means for movably supporting the changing rod, an electromagnetic coil being provided in the support means and surrounding the movable iron core, and a second magnet secured to the support means and facing the first magnet, the first and second magnets being of the same pole so that the first and second magnet normally repulse each other, wherein the changing rod moves in a first direction when electricity is to the electromagnetic coil and the changing rod moves in a second direction when electricity is not applied to the coil due to the repulsive force of the first and second magnets.

10. An apparatus for winding a package according to claim 7, wherein the diameter detecting means comprises:

a package diameter detection lever which is movably displaced about a shaft as the diameter of a package increases, the package detection level including an arc-shaped portion having a plurality of projections, and a limit switch including a lever on which a roller is supported, the roller contacting the arc-shaped portion of the package diameter detection lever, wherein the plurality of projections push the roller to activate the limit switch based on the package diameter.

11. An apparatus for winding a package according to claim 10, wherein the changing means is controlled based on the operation of the limit switch.

12. An apparatus for winding a package according to claim 7, wherein the second predetermined set of values correspond to values at which ribbon winding occurs.

* * * * *